US005442531A

United States Patent [19]

Lee

[11] Patent Number: 5,442,531

[45] Date of Patent: Aug. 15, 1995

[54] MODULAR LIGHT DISPLAY APPARATUS

[76] Inventor: Kuo-Hsing Lee, 10139 Duchamp, Houston, Tex. 77036

[21] Appl. No.: 247,683

[22] Filed: May 23, 1994

[51] Int. Cl.[6] ..... F21V 21/00

[52] U.S. Cl. ..... 362/249; 362/153.1; 362/382; 362/808

[58] Field of Search ..... 362/249, 250, 252, 258, 362/387, 391, 806-808, 145, 153, 153.1, 382; 439/207-210, 214

[56] References Cited

U.S. PATENT DOCUMENTS

| | | | |
|---|---|---|---|
| 1,702,028 | 2/1929 | Blanchard | 362/249 |
| 2,722,317 | 11/1955 | Goodwin | 362/807 |
| 4,462,065 | 7/1984 | Rhodes | 362/250 |
| 4,482,944 | 11/1984 | Roossine et al. | 362/252 |
| 4,523,260 | 6/1985 | Duncan | 362/807 |
| 4,769,749 | 9/1988 | Felski | 362/250 |
| 4,821,158 | 4/1989 | Mitten | 362/249 |
| 4,852,832 | 8/1989 | Delaney | 362/391 |

*Primary Examiner*—Ira S. Lazarus

*Assistant Examiner*—Alan B. Cariaso

*Attorney, Agent, or Firm*—Bill B. Berryhill

[57] ABSTRACT

Modular light display apparatus for mounting a string of electric lights which has a plurality of light sockets and corresponding light bulbs connected at spaced intervals to electrically conducting wire. The light display apparatus comprises two or more pre-shaped modular light holders the ends of which are removably engageable with corresponding stationarily disposed objects to provide for mounting of the string of electric lights in a display of predetermined configuration. Each of the modular light holders comprises an elongated member of generally U-shaped cross-section to provide a channel in which the string of electric lights may be disposed. A plurality of uniformly spaced holders each one of which is engageable with one of the light sockets of said string of electric lights may be provided within the channel so that when viewed from at least one side of the modular light holder, the light sockets are hidden within the channel and the light bulbs project upwardly from the channel.

10 Claims, 3 Drawing Sheets

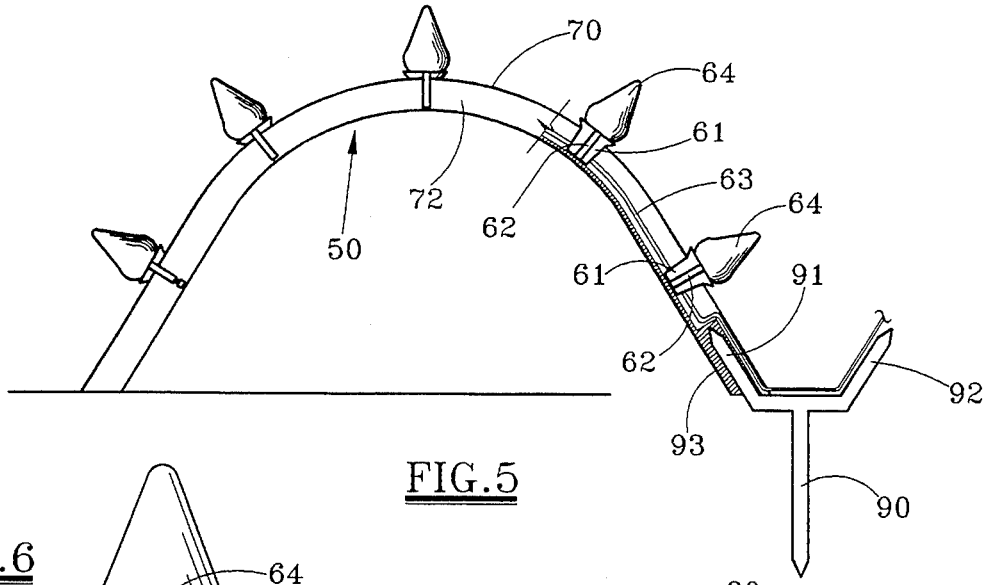
FIG.5
FIG.6
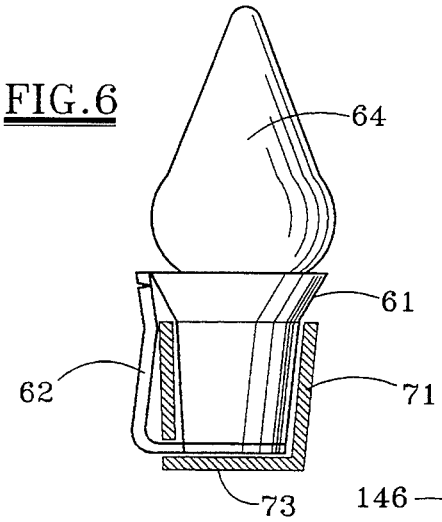
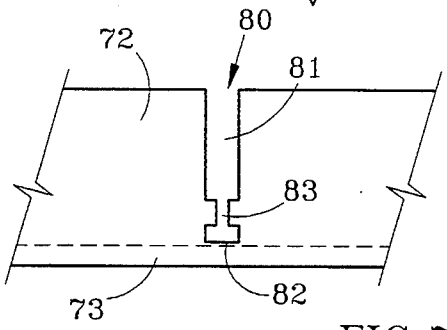
FIG.7
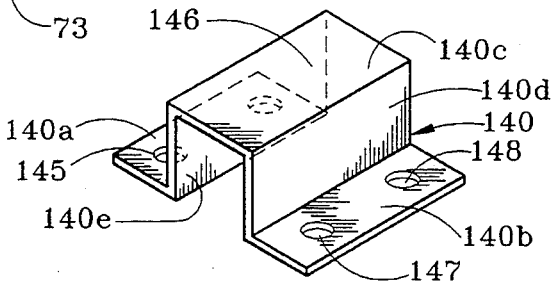
FIG.12
FIG.11
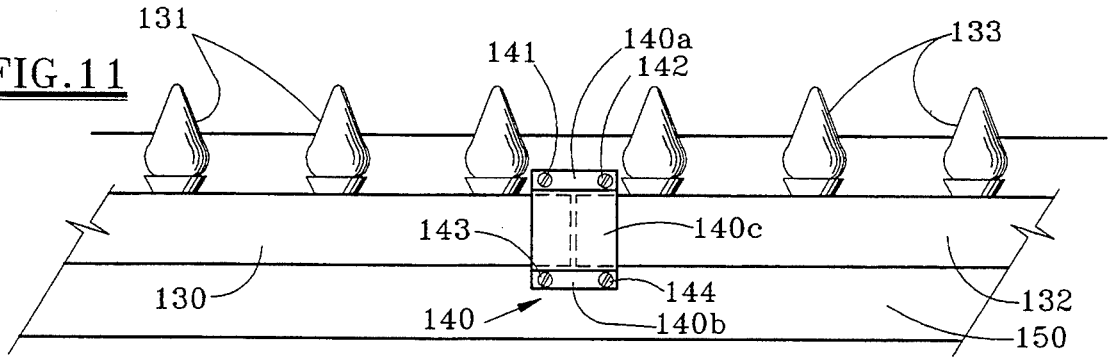

MODULAR LIGHT DISPLAY APPARATUS

BACKGROUND OF THE INVENTION

1. Field of the Invention

The present invention pertains to apparatus for mounting a string of electric lights in a display of pre-determined configuration. More specifically, the present invention pertains to pre-shaped modular light holders which are removably engageable with stationary objects to provide for mounting of a string of electric lights in a display of pre-determined configuration.

2. Brief Description of the Prior Art

Various kinds of electric lights are manufactured which include a plurality of light bulbs and corresponding light sockets connected at spaced intervals to electrically conducting wire. The lamps may be connected in series or parallel. Typical of such lights are the kind sold for Christmas or other holidays which allow a multiplicity of lights to be strung around a Christmas Tree or on other objects as decoration. Such lights may also be used in commercial lighting displays.

Frequently, displayers of electric lights wish to use the lights in outlining, highlighting or actually defining a particularly shaped object or objects. For example, at Christmas, the displayer may wish to use the lights in spelling words such as "Merry Christmas" or "Happy Holidays" or they may wish to outline the representation of a Christmas Tree or a reindeer. A displayer may simply want to provide a display of uniform shapes or designs such as circles, scallops, etc. along the edge of a sidewalk, flower bed, etc. Although light bulbs may be uniformly spaced at intervals on electric wiring, they are not easily held or placed in such a display of pre-determined configuration.

Various apparatus have been designed for displaying electric lights in pre-determined configurations. Examples of such may be seen in the following U.S. patents: Pat. No. 2,595,929; Pat. No. 3,404,268; Pat. No. 3,836,760; Pat. No. 4,439,818; Pat. No. 4,769,749; Pat. No. 5,057,981. In all these patents some type of support is provided to position lights, particularly Christmas Tree type lights, in a design display. Most of them provide some sort of socket mounting device so that the sockets in individual lamps or lights may be held in pre-determined array positions.

The devices of some of the afore-mentioned patents are flexible, allowing the apparatus to be deformed into a particular design. In most of these designs, the wiring and bulb sockets are visible. This may detract from the overall appearance of the design U.S. Pat. Nos. 3,404,268; 3,836,760 and 4,439,818 do disclose mounting apparatus which provides a mask or cover for wiring and light sockets. However, the apparatus of these particular patents appear to require permanent light and wire mounting and do not allow display of conventional strings of electric lights in varying designs and configurations. Furthermore, the designs of the prior art appear to require attachment to the surface of an object such as the wall or eave of a house, etc.

Electric light strings and displays continue to increase in popularity. Their increased use and popularity has resulted in continuing demand for associated apparatus in which lights can be displayed in pre-determined configurations. Continued development in this area appears to be needed.

SUMMARY OF HE PRESENT INVENTION

The present invention provides modular light display apparatus for mounting a string of electric lights of the type having a plurality of light sockets and corresponding light bulbs connected at spaced intervals to electrically conducting wire. In the light display apparatus of the present invention, two or more pre-shaped modular light holders the adjacent ends of which are removably engageable with a stationarily disposed object, provide for mounting the string of electric lights in a display of predetermined configuration. Each of the modular light holders of the present invention comprises an elongated member of generally U-shaped cross-section so as to provide a channel in which the string of electric lights may be disposed. The elongated member is provided within its channel with a plurality of uniformly spaced holders each one of which is engageable with one of the light sockets of the string of electric lights so that when viewed from at least one side of the modular light holder, the light socket is hidden within the channel and the light bulb projects upwardly from the channel to provide the display of pre-determined configuration.

In a preferred embodiment of the invention, the stationarily disposed object to which adjacent ends of the modular light holders are removably engaged may include a stake which is insertable into the ground and the upper end of which is forked to provide at least a pair of upwardly directed prongs, each of which is engageable with a corresponding socket provided on adjacent ends of the modular light holders. In other embodiments, the ends of the modular light holders may be provided with prongs which are insertable into the ground or some type of mounting plate may be provided for attachment to some other object, such as the wall of a house, and may provide a pair of socket members into which corresponding adjacent ends of the modular light holders may be inserted.

The uniformly spaced holders provided within the channel of the elongated member of the modular light holders may be of several designs. In a preferred embodiment, the uniformly spaced holders may comprise pads projecting away from the walls of the channel and which may be provided with recesses for partially encircling one of the light sockets so that its corresponding light bulb projects upwardly from the channel. In another embodiment, uniformly spaced holders may be provided by elongated slots cut through one wall of the elongated member for slidingly receiving a clip member extending from a light socket of a string of electric lights so that its corresponding light bulb projects upwardly from the channel.

In all embodiments of the modular light display apparatus of the present invention, the light sockets and electrically conducting wire are hidden so that only the light bulbs are seen when arranged in a pre-determined configuration. The modular light display of the present invention is particularly adaptable for use with conventional strings of electric lights allowing for more variation in designs and being generally less expensive than predetermined design arrangements. Such an arrangement also results in reduced storage space required when not in use. Many other objects and advantages of the invention will be apparent from reading the description which follows in conjunction with the accompanying drawings.

BRIEF DESCRIPTION OF THE DRAWINGS

FIG. 5 is a side elevation view of a modular light holder, particularly designed for a string of lights having a different type of light socket, according to a preferred embodiment of the invention, FIG. 6 is a sectional view of the modular light holder of FIG. 5 illustrating the mounting of a light socket and light bulb therein;

FIG. 7 is an enlarged detail of a portion of the modular light holder of FIGS. 5 and 6;

FIG. 11 is an elevation view of a modular light display in which pre-shaped modular light holders are utilized according to still another embodiment of the invention; and FIG. 12 is a perspective view of a mounting plate utilized in modular light display apparatus of the type shown in FIG. 11.

DESCRIPTION OF A PREFERRED EMBODIMENT

Figure 1:
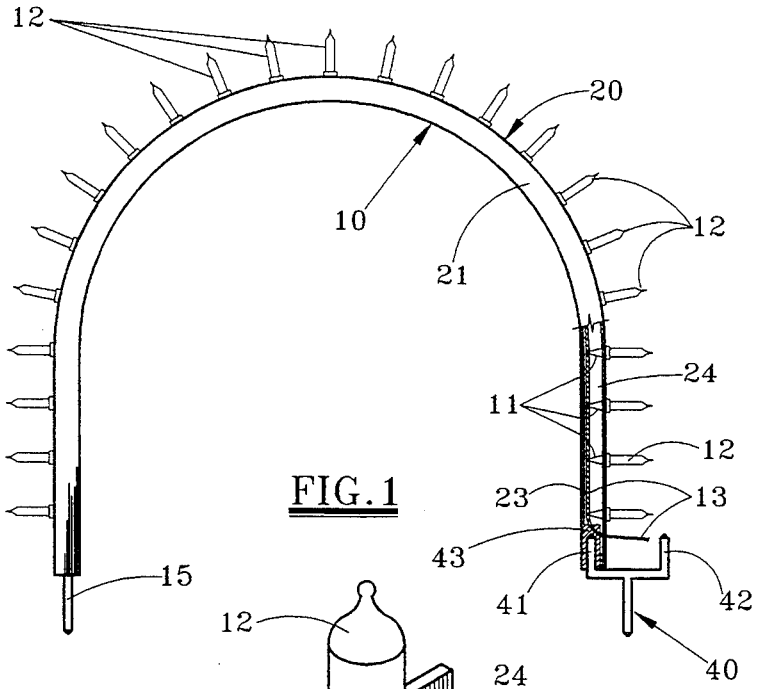
FIG. 1 is a side elevation view of a pre-shaped modular light holder to provide for mounting of a string of electric lights in a display of pre-determined configuration, according to a preferred embodiment of the invention.
Figure 2:
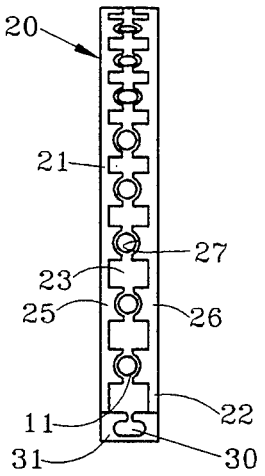
FIG. 2 is an end elevation view of the pre-shaped modular light holder of FIG. 1.
Figure 3:
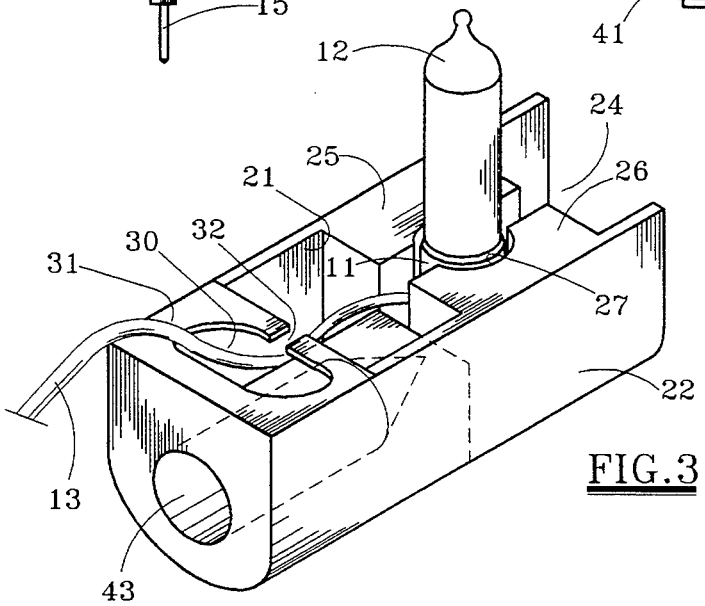
FIG. 3 is an enlarged detail, in perspective, of one end of the pre-shaped modular light holder of FIGS. 1 and 2, illustrating the mounting of individual light sockets and bulbs therein, according to a preferred embodiment of the invention.

Referring first to FIGS. 1–3, there is shown a pre-shaped modular light holder 10 the ends of which are removably engageable with a stationarily disposed object to provide for mounting a string of electric lights in a display of pre-determined configuration. The string of electric lights is the type having a plurality of light sockets 11 and corresponding light bulbs 12 connected at spaced intervals to electrically conducting wire 13.

Each of the modular light holders 10 comprises an elongated member 20 of generally U-shaped cross-section having, for example, a forward wall 21 and a rearward wall 22 connected by a bottom wall 23 to provide a channel in which a string of electric lights may be disposed. The elongated member 20 is provided within the channel 24 with a plurality of uniformly spaced holders engageable with one of the light sockets 11 of the string of electric lights so that when viewed from at least one side of the modular light holder 10, i.e. as in FIG. 1, the light sockets 11 are hidden within the channel 24 and the light bulbs 12 project upwardly from the channel 24 to provide a display of pre-determined configuration.

In the preferred embodiment of FIGS. 1–3, the light holders, as best seen in FIG. 3, comprise receiving pads 25,26 which project away from opposite walls 21,22 of the elongated member 20. The pads 25,26 are preferably provided with recesses, e.g. 27, for receiving and partially encircling one of the light sockets 11 so that its corresponding light bulb 12 projects upwardly from the channel 24. Actually the pads 25,26 may simply be formed by increasing the wall thickness of the walls 21,22. In any case the light socket 11 may be removably placed within the holder area between the walls 21,22.

In the preferred embodiment of FIGS. 1–3, each end of the elongated member 20 may also be provided with a wire receiving aperture 30 through which the electrical conducting wire 13 may extend from the channel 24 for engagement with a similar aperture in an adjoining light holder. The wire receiving aperture 30 may be provided with a web member 31 which is disposed across the channel 24 and provided with a slot 32 which communicates with the aperture 30. The electrically conducting wire 13 may be inserted through the slot 32 for removable placement within the aperture 30. The width of the slot 32 is preferably less than the major dimension of the aperture 30.

As previously mentioned, the adjacent ends of the modular light holder 10 are removably engageable with stationarily disposed objects, e.g. the ground. In the embodiment of FIG. 1, one end of the modular light holder 10 is provided with a prong 15 which may be insertable into the ground (the stationarily disposed object). Or, the stationarily disposed object may be provided with a stake such as the stake 40 illustrated at the opposite end of the modular light holder of FIG. 1. This stake may be insertable into the ground and the upper end of the stake 40 may be forked to provide at least a pair of upwardly directed prongs 41 and 42 each of which is engageable with a corresponding socket provided on adjacent ends of modular light holders. The socket 43 of the modular light holder 10, as best seen in FIG. 3, is simply a socket which is correspondingly shaped and sized to receive the prong 41 in a sliding fit.

Figure 4:
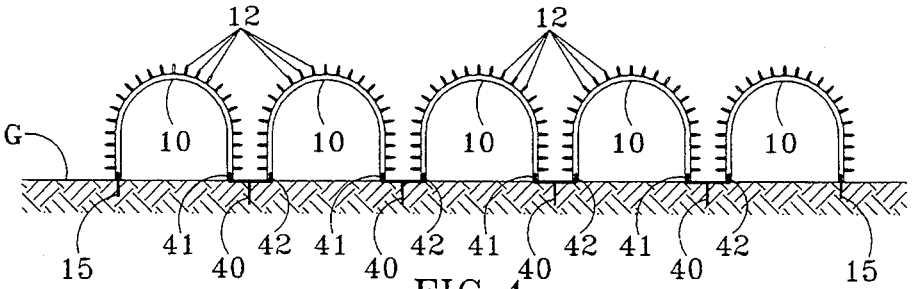
FIG. 4 is an elevation view of a modular light display in which five pre-shaped modular light holders, similar to those shown in FIGS. 1–3, are arranged in a display of pre-determined configuration, according to a preferred embodiment of the invention.

As shown in FIG. 4, several of the modular light holders 10 are arranged in a display of pre-determined configuration by engaging the ends thereof with the upwardly extending forks 41,42 of corresponding stakes 40 such as the stake 40 of FIG. 1. The particular light holders 10 which form the ends of the display may be provided with prongs 15 or simply not attached to anything.

Referring now to FIGS. 5–7, there is shown a modular light holder 50 of a slightly different design, according to another preferred embodiment of the invention, particularly adapted for use with strings of electric lights which have electric light socket 61 which are provided with clips 62. Of course these sockets are connected by electric wiring 63 and provided with corresponding light bulbs 64. Like in the previously described embodiment the pre-shaped modular light holder 50 comprises an elongated member 70 of generally U-shaped cross-section. Elongated member 70 has a forward wall 71, a rear wall 72 and a connecting bottom wall 73. One of these walls, the rear wall 72 in the preferred embodiment of FIGS. 5–7, has elongated slots 80 cut therethrough for slidingly receiving a clip member 62 which extends from the light socket 61 so that its corresponding light bulb 64 will project upwardly from the channel of the modular light holder 70. In the preferred embodiment of FIGS. 5–7, the elongated slot 80 includes an entrance portion 81, end portion 82 and an intermediate portion 83 therebetween. The entrance portion 81 provides an opening through the edge of the wall 72. The end portion 82 provides a place for receiving the clip member 62 so that its light bulb 64 projects properly upwardly. The intermediate portion 83 is of a reduced width which allows the clip member 62 to move through the entrance portion 81 of a slot 80 into the end portion 82 but prevents accidental disengagement of the clip 62 therefrom.

The ends of the modular light holder 50 may be provided, as in the embodiment of FIGS. 1–3, with a socket 93 for receiving the prongs 91,92 of a stake 90 which may be driven into the ground. As illustrated with stake 40 in FIG. 4 a plurality of the modular light holders 50 may also be arranged in a display of pre-determined configuration such as shown in FIG. 4.

Figure 8:
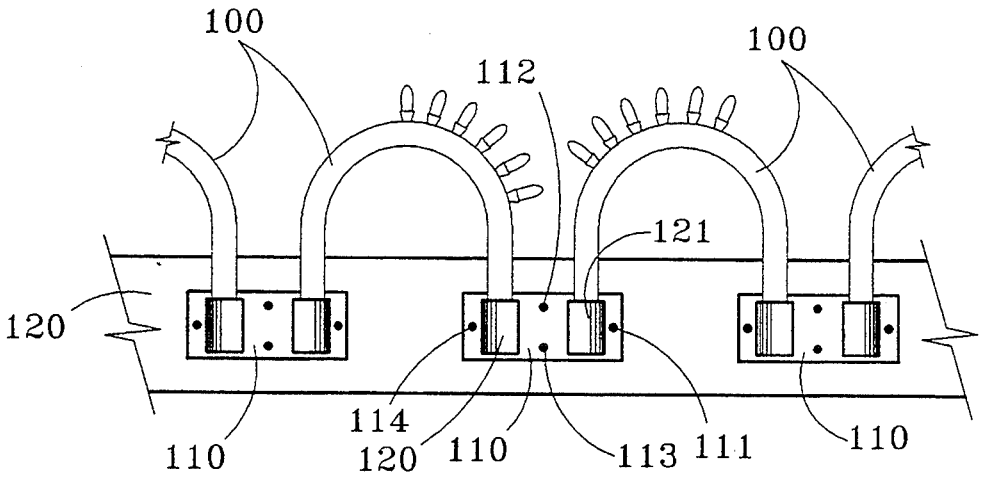
FIG. 8 is an elevation view of a modular light display in which pre-shaped modular light holders are utilized, according to another embodiment of the invention.
Figure 9:
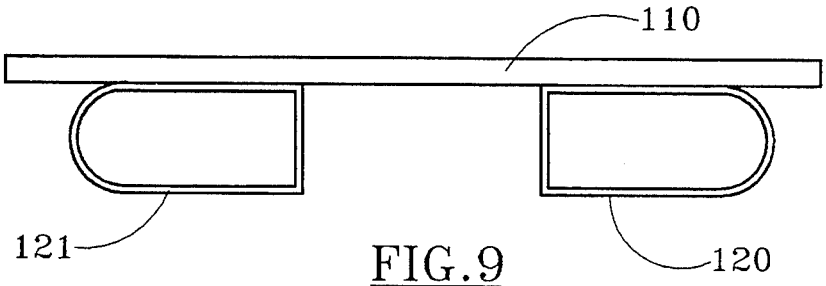
FIG. 9 is a top view of a mounting plate, utilized in modular light display apparatus of the type shown in FIG. 8.
Figure 10:
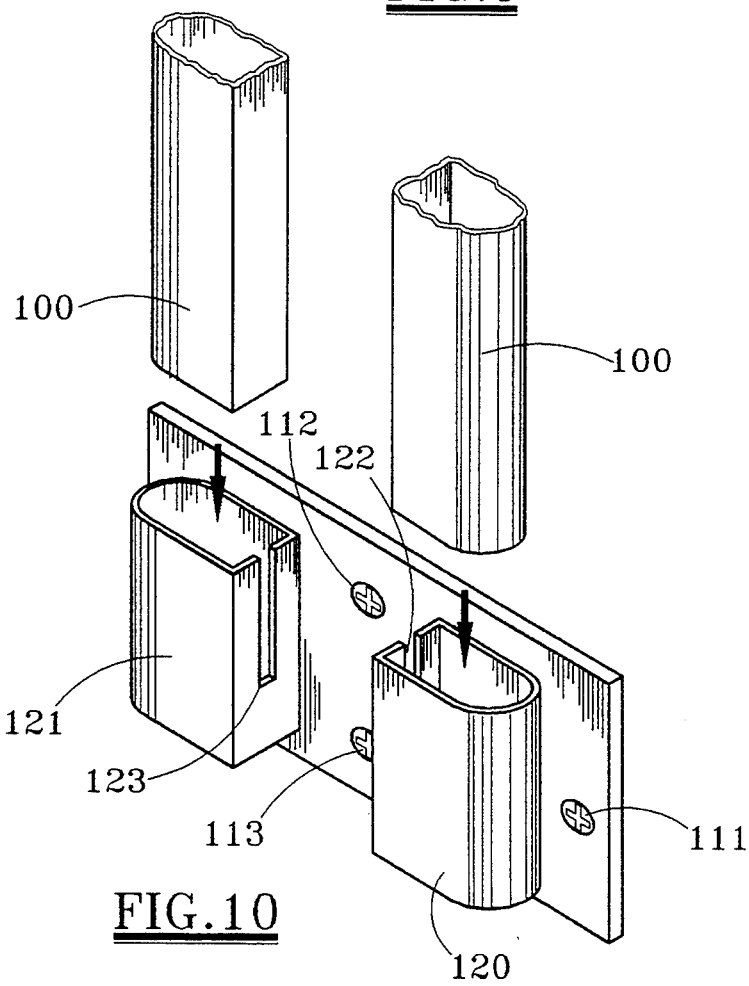
FIG. 10 is a perspective view of the mounting plate of FIG. 9 showing the ends of a pair of modular light holders for engagement therewith to produce the modular light display represented in FIG. 8, according to an embodiment of the invention.

FIGS. 8–10 illustrate still another embodiment of the invention in which a plurality of modular light holders 100 are mounted for displaying a string of electric lights in a predetermined configuration. The modular light holders 100 may take the general form of those illustrated in FIGS. 1–7 and may comprise elongated members of generally U-shaped cross-section to provide a channel in which the string of electric lights may be disposed. However, in the embodiment of FIGS. 8–10, the ends of the modular light holders 100 are mounted in a different fashion. They are engaged in sockets provided on a mounting plate. The mounting plate 110 is a flat plate which may be provided with holes for engagement by fastening screws 111–114, etc. for attaching the plate member to a wall, such as the fascia board 120 of a house, for mounting several modular light holders 100 in a display of pre-determined configuration. The plate member may be provided with a pair of sockets 120,121 of U-shaped cross-section to receive correspondingly U-shaped ends of the modular light holders 100, as best seen in FIG. 8 and FIG. 10. Slots 122 and 123 allow wiring to pass from one light holder 100 to another.

FIGS. 11 and 12 illustrate another embodiment in which a plurality of modular light holders 130,132 are mounted for displaying strings of electric lights 131,133 in a predetermined configuration. Like in previous embodiments, the light holder 130,132 may comprise elongated members of generally U-shaped cross-section to provide a channel in which a string of electric lights may be disposed. In the embodiment of FIGS. 11 and 12, the ends of the modular light holders 130,132 engage sockets provided in a mounting plate 140 in much the same fashion as in the embodiment of FIGS. 8, 9 and 10. However, in the embodiment of FIGS. 11 and 12 the sockets are horizontal instead of vertical.

The mounting plate 140, as best seen in FIG. 12, has parallel side walls **140*d*, 140*e* joined by a transverse wall 140*c*. Extending from the free edges of the side walls 140*d*, 140*e* are a pair of mounting strips 140*a* and 140*b* in which are provided holes or apertures 145, 146, 147 and 148. These holes 145–148 allow attachment of the mounting plate 140 to a wall or member 150 by screws 141, 142, 143, 144 such as is shown in FIG. 11. The walls 140*c*, 140*d*, 140*e* and the member 150 to which the mounting plate 140 is attached define a rectangular socket or sockets in which corresponding adjacent ends of the light holders 130,132 may be received, as shown in FIG. 11**.

Thus, the modular light display apparatus of the present invention provides a means of mounting a string of electric lights, with a plurality of light sockets and corresponding light bulbs, in a display of pre-determined configuration so that when viewed from at least one side, the light sockets and wiring are hidden and the light bulbs project upwardly to provide the display. The modular light holders of the present invention are conveniently designed to receive a conventional string of electric lights in a number of designs. The apparatus is particularly useful in providing displays on the ground but may be adapted for attachment to other fixed objects such as the wall of a house.

Four embodiments of the invention have been described herein. However, many variations of these embodiments can be made without departing from the spirit of the invention. Accordingly, it is intended that the scope of the invention be limited only by the claims which follows.

I claim:

1. Modular light display apparatus for mounting a string of electric lights which has a plurality of light sockets and corresponding light bulbs connected at spaced intervals to electrically conducting wire, said light display apparatus comprising two or more pre-shaped modular light holders having adjacent ends which are provided with sockets which are removably engageable with corresponding upwardly directed prongs provided by a forked upper end of a stake which is insertable into the ground to provide for independent mounting of said string of electric lights in a display of predetermined configuration, each of said modular light holders comprising an elongated member of generally U-shaped cross-section to provide a channel in which said string of electric lights may be disposed, said elongated member being provided within said channel with a plurality of uniformly spaced holders each one of which is engageable with one of the light sockets of said string of electric lights so that when viewed from at least one side of said modular light holder said light socket is hidden within said channel and said light bulb projects upwardly from said channel to provide said display of predetermined configuration.

2. Modular light display apparatus as set forth in claim 1 in which another end of at least one of said modular light holders is provided with a prong insertable into the ground.

3. Modular light display apparatus as set forth in claim 1 in which said elongated members of U-shaped cross section comprises a forward wall and a rearward wall connected by a bottom wall and in which each of said uniformly spaced holders comprises predetermined receiving means along said walls within said channel, said receiving means having recesses therein for at least partially encircling one of said light sockets so that its corresponding light bulb projects upwardly from said channel.

4. Modular light display apparatus as set forth in claim 3 in which said receiving means comprise pads which project from said forward and rearward walls and in which said recesses are provided.

5. Modular light apparatus as set forth in claim 3 in which said receiving means comprises recesses formed in at least one of said forward and rearward walls.

6. Modular light apparatus as set forth in claim 1 in which each end of said elongated member is provided with a wire receiving aperture through which said electrically conducting wire may extend from the channel of one light holder to the channel of another light holder.

7. Modular light apparatus as set forth in claim 6 in which said wire receiving aperture is provided in a web member disposed across said channel, said web member also being provided with a slot which communicates with said aperture and through which said electrically conducting wire may be removably placed within said aperture.

8. Modular light apparatus as set forth in claim 7 in which the width of said slot is less than the major dimension of said aperture.

9. Modular light apparatus as set forth in claim 1 in which said elongated member of U-shaped cross-section comprises a forward wall and a rearward wall connected by a bottom wall and in which each of said uniformly spaced holders comprises an elongated slot cut through the wall of one of said forward and rearward walls of said elongated member for slidingly receiving a clip member extending from one of said light sockets so that its corresponding light bulb projects upwardly from said channel.

10. Modular light display apparatus as set forth in claim 9 in which said elongated slot comprises an entrance portion, an end portion and an intermediate portion therebetween, said entrance portion providing an opening through the edge of said wall, said end portion providing a place for receiving said clip member so that its corresponding light bulb properly projects upwardly from said channel, said intermediate portion being of a reduced width to allow said clip member to move through said entrance portion of said slot into said end portion of said slot but to prevent accidental disengagement therefrom.

* * * * *